United States Patent [19]

Johnson

[11] 4,386,576

[45] Jun. 7, 1983

[54] GLUE APPLICATOR FOR PAPER CUP MACHINES

[75] Inventor: Craig N. Johnson, Milwaukee, Wis.

[73] Assignee: Paper Machinery Corporation, Milwaukee, Wis.

[21] Appl. No.: 338,348

[22] Filed: Jan. 11, 1982

[51] Int. Cl.[3] ..... B05C 1/02

[52] U.S. Cl. ..... 118/211; 118/241; 118/266; 222/187; 401/196; 401/198; 401/204

[58] Field of Search ..... 118/266, 211, 265, 267, 118/241, 401; 401/196, 198, 202–207; 222/187

[56] References Cited

U.S. PATENT DOCUMENTS

| | | | |
|---|---|---|---|
| 2,032,603 | 3/1936 | Taylor | 118/266 X |
| 2,308,215 | 1/1943 | Stern | 222/187 X |
| 3,766,879 | 10/1973 | Jones | 401/204 X |

*Primary Examiner*—John P. McIntosh

*Assistant Examiner*—M. B. Calligaris

*Attorney, Agent, or Firm*—James E. Nilles

[57] ABSTRACT

A dripless, easily cleaned glue applicator for a machine for making two-piece paper cups comprises an outer body member in which there is a cavity that opens to a slot in a flat bottom surface of the member. The slot has a shape and size conforming to an area of glue to be applied. An inner member in the body member forces the longitudinally central portion of a resilient foam pad to bulge down through the slot and clamps the pad to the outer body member. The inner member also provides a glue chamber that is communicated with a pressurized source of glue and from which numerous bores, spaced along the length of the inner member, open downwardly to the pad. A top plate on the outer body member closes its cavity, holds the inner member in clamping relation to the outer body member, and provides for mounting the applicator.

2 Claims, 7 Drawing Figures

GLUE APPLICATOR FOR PAPER CUP MACHINES

FIELD OF THE INVENTION

This invention relates to a glue applicator by which a blank of paper or the like can be coated with glue in a long, narrow area thereof; and the invention is more particularly concerned with a glue applicator for a machine for making two-piece paper cups, whereby glue is applied in a narrow zone along one side edge and along the bottom edge of the side wall blank for each cup, to form the side and bottom seams for the finished cup.

BACKGROUND OF THE INVENTION

Conventionally, a two-piece paper cup or similar container is made up from a more or less keystone-shaped side wall blank and a disc-like bottom wall blank. The side wall blank usually has downwardly convergent side edges, a concavely curved bottom edge, and a convexly curved top edge. Before the two blanks are assembled with one another, the marginal portion of the bottom wall blank is bent or crimped to form it into an axially projecting flange which is to be bonded to the side wall of the cup.

For assembly of the two blanks, a strip-like coating of glue is applied along one side edge of the side wall blank and along its curved bottom edge. The bottom wall blank is attached by suction to the small diameter end of a tapering mandrel, and the glue coated side wall blank is wrapped around the mandrel to bring its side edge portions into overlapping relation to one another for formation of a side seam. The coating of glue along the bottom edge of the side wall blank bonds that portion of it to the flange on the bottom wall blank and forms a bottom seam.

Heretofore there has been no completely satisfactory device for applying glue to paper cup side wall blanks. For high production, the glue applicator must be moved down into contact with each blank and immediately withdrawn upwardly from it; and during the brief instant of contact a thin but even coating of glue must be applied to the desired area of the blank.

One type of prior glue applicator comprised a body having a flat bottom surface and in which there was a narrow, elongated manifold passage which was communicated with a source of glue and from which restricted outlets opened downward to the bottom surface. Because of the viscosity of the high-tack glue needed for paper cup manufacture (usually of a polyvinyl acetate type) the glue was normally delivered to the glue applicator under pressure, and the glue outlets were in the form of narrow slots or small holes through which the glue issued onto the blank. Delivery of glue from the pressurized source to the glue applicator was valved in synchronism with the up and down movement of the applicator. Since glue issued from the outlets in a pattern of discrete dots or spots, enough glue had to be applied for some spreading of glue to take place, so that there would be a continuous film over the whole of the coated area, but of course an excessive application of glue was almost as undesirable as an insufficient one. The individual glue outlets had to be small enough for a capillary effect by which glue was prevented from dripping out of the applicator (although a certain amount of dripping was nearly inevitable), and therefore the size of the outlets was very critical.

With a new, clean applicator, just the right amount of glue could be applied at each operation, over exactly a desired area. However, any accidental denting of the applicator could result in a total or partial blockage of one or more of its outlets that would disturb the pattern of application. More significantly, any interruption of operations would allow glue to dry around the edges of the outlets and block them. Because of the small size of the outlets, cleaning them of dried glue was a time consuming and rather difficult task.

Other types of glue applicators that have been used in paper cup machines have had other disadvantages. In some cases, glue was applied by means of a roller applicator that was moved along the blank. Such an applicator was slow and required a complicated and expensive mechanism for effecting roller traverse. In other cases glue was applied to a plate, analogously to the application of ink to a printing press plate, and the plate was then brought into contact with the blank. Here, again, complex mechanism was needed.

SUMMARY OF THE INVENTION

The general object of the present invention is to provide a simple and inexpensive glue applicator, particularly well suited for machines for making two-piece paper cups, whereby a uniform coating of glue can be applied to a blank over a desired area thereof by merely contacting the applicator briefly against the blank, and whereby very consistent coating applications are obtained.

Another object of this invention is to provide a substantially improved glue applicator of the character described that is directly interchangeable with prior applicators that were intended for connection with a pressurized glue source and had numerous small glue outlets, so that the improved applicator of this invention can be installed on a paper cup making machine without need for any alterations or modifications in the machine itself.

A further object of this invention is to provide a glue applicator of the character described which is not only simple and inexpensive in itself but which tends to be selfcleaning after a short interruption in use and can be very quickly and easily cleaned of dried and partially dried glue if subjected to a longer period of shut-down.

It is also an important object of this invention to provide a glue applicator of the character described which can be manufactured easily and inexpensively because it does not have narrow passages of delicately critical dimensions but which nevertheless applies very uniform and consistent glue films to exactly the desired areas of a blank, and which has no tendency to drip.

In general, these and other objects of the invention that will appear as the description proceeds are achieved in a glue applicator of the character described that comprises a body member wherein there is a cavity that opens downwardly through an elongated slot in a flat bottom surface of the body member. The slot substantially conforms in shape and size to an area of glue to be applied, and said cavity has opposite lower surface portions that extend along the full length of said slot and converge downwardly, terminating at the opposite longitudinal edges of the slot. A pad of resilient foam material that is longer and wider than said slot is received in the bottom portion of said cavity. A hollow inner member that is confined in said cavity has an elongated downwardly projecting ridge portion which is received between said lower surface portions of the cavity along substantially the full length of said slot, and which forces a central portion of the pad to bulge through said slot, to below the plane of said bottom surface, while cooperating with said surface portions to clamp portions of the pad that are on opposite sides of said central portion and extend all along the same. The inner member defines an elongated glue receiving chamber which is above said ridge portion along substantially the full length thereof and which is communicable with a source of glue under pressure. Said ridge portion has a plurality of outlets therethrough, at spaced intervals along the length thereof, that open downwardly from said chamber for conducting glue from said chamber to said pad.

BRIEF DESCRIPTION OF DRAWINGS

In the accompanying drawings, which illustrate what are now regarded as preferred embodiments of the invention.

DETAILED DESCRIPTION OF PREFERRED EMBODIMENTS OF THE INVENTION

A machine for manufacturing two-piece paper cups has a turret 5 which carries several sets of grippers 6 and which is indexingly rotated about a vertical axis to carry each set of grippers to each in turn of a succession of stations. When a set of grippers 6 is at a loading station 7, the grippers are initially open to receive a keystone-shaped side wall blank 8 that is inserted between the grippers by known mechanism (not shown), whereupon the grippers 6 close upon the blank 8 to clamp it for edgewise transport by the turret. As held by the grippers 6, the blank 8 is horizontal.

Figure 1:
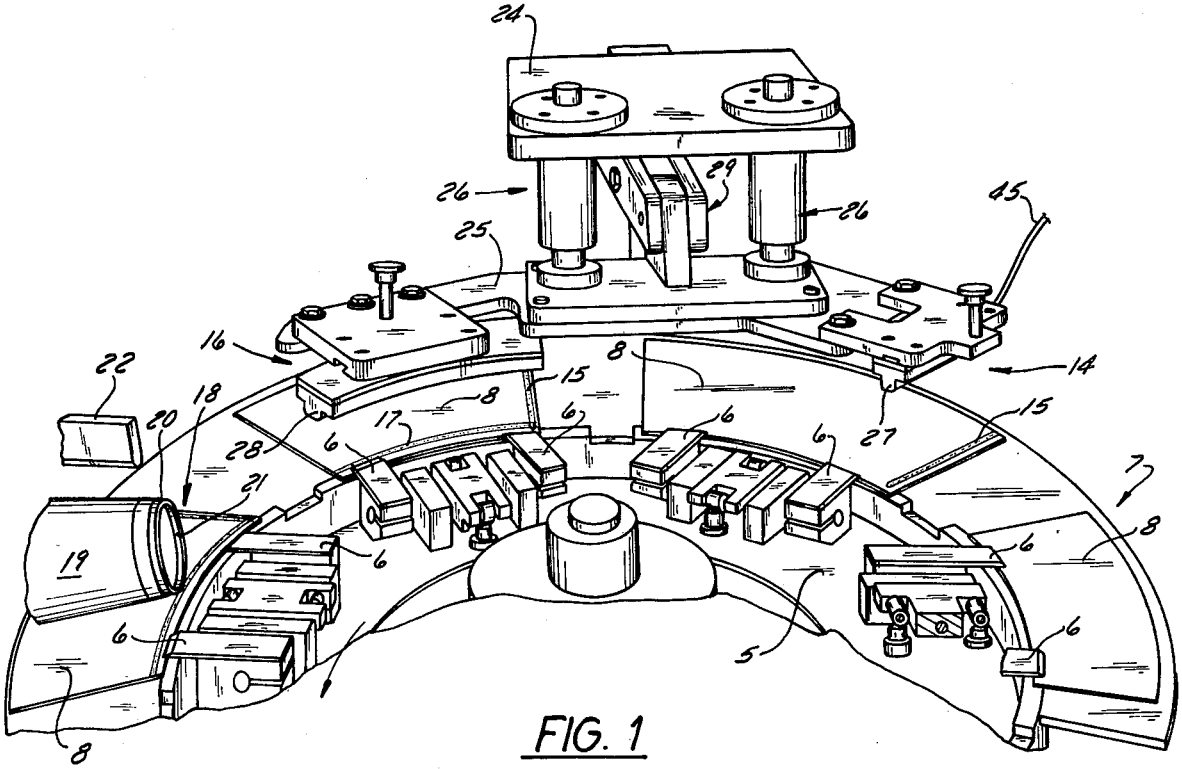
FIG. 1 is a partial top perspective view of the portion of a machine for manufacturing two-piece paper cups that incorporates a glue applicator embodying the principles of this invention.
Figure 2:
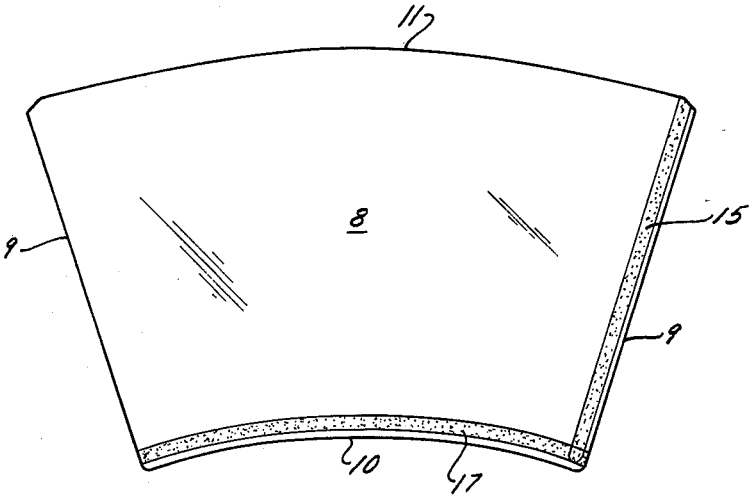
FIG. 2 is a plan view of a side wall blank for a conventional two-piece paper cup, to which areas of glue film have been applied by means of glue applicators of this invention.

As can be seen from FIG. 2, the side wall blank 8 has opposite downwardly convergent side edges 9, a concavely curved bottom edge 10, and a convexly curved top edge 11.

After a side wall blank 8 is clamped by a set of grippers 6, an indexing movement of the turret carries that blank to a first gluing station 14 at which a film of glue is applied to it in a stripe-like area 15 along one of its side edges 9. The next indexing movement of the turret 5 carries the blank to a second gluing station 16 at which a film of glue is applied to a stripe-like area 17 that is adjacent to the curved bottom edge 10 of the blank and extends all along that edge.

At the next station 18 to which the blank 8 is carried by indexing rotation of the turret 5 there is a tapering mandrel 19. In a known manner, a disc-like bottom blank 20 is attached by suction to the small diameter end of the mandrel 19, with the bent-out circumferential flange 21 of that blank projecting axially away from the mandrel. When the glue-coated side wall blank 8 is brought to this station 18, a known mechanism rolls the side wall blank 8 around the mandrel 19, bringing the side edge portions of that blank into overlapping relationship to one another so that they can be bonded together by the area 15 of glue on the radially outermost side edge portion. Also operating in a known manner, a pressure bar 22 descends onto the overlapped side edge portions, clamping them against the side surface of the mandrel 19 to ensure the bonding of a leakproof side seam.

After the side wall blank 8 is rolled around the mandrel 19, an end portion of the mandrel may be displaced axially outwardly by a small distance to wedge the bottom wall blank 20 firmly into the bottom end portion of the rolled up side wall blank, so that the flange 21 on the bottom blank can be securely bonded to the side wall all around a bottom seam that is provided by the second glue film area 17.

After assembly of the cup is completed by the process just described, certain finishing and trimming operations are performed upon it that are well known in themselves.

Turning now to a more detailed consideration of the glue applying mechanism at the gluing stations designated by 14 and 16, it comprises an elevated supporting frame 24 that is mounted substantially between the two gluing stations, a mounting plate 25, and a pair of telescoping guide elements 26 that are connected between the supporting frame 24 and the mounting plate 25 to confine the latter to up and down movement. The mounting plate 25 extends a substantial distance in both directions circumferentially of the turret 5, and secured to it, at its underside, are two glue applicators 27 and 28, one at each of the gluing stations 14 and 16. An actuator designated generally by 29 moves the mounting plate 25 between a raised or retracted position and a lowered operative position. In the raised position of the mounting plate 25, which it occupies whenever the turret 5 is indexing, the glue applicators 27 and 28 are spaced above the plane of edgewise movement of side wall blanks 8 carried by the turret. When the turret 5 is stopped, the actuator 29 lowers the mounting plate 25 to bring the glue applicators into brief contact with side wall blanks 8 at the respective gluing stations 14 and 16, and then immediately lifts the mounting plate back to its raised position. The mechanism comprising the mounting plate 25 and the means for supporting, guiding and actuating it is generally known, being shown and described in U.S. Pat. No. 3,364,825 to D. W. Baumgartner, and having been embodied in machines made and sold by the assignee of that patent, to whom this application is assigned.

Figure 3:
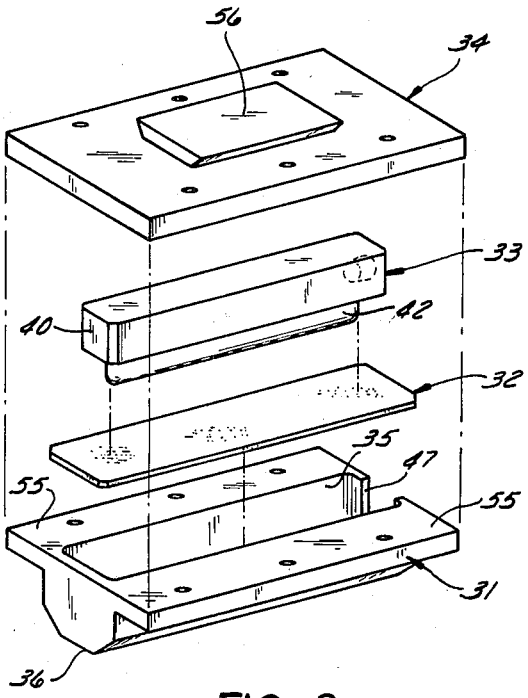
FIG. 3 is a disassembled perspective view of one embodiment of a glue applicator of this invention, whereby glue is applied along a side edge of a side wall blank.

The glue applicator 27 at the first gluing station 14, which applies a straight stripe 15 of glue along a side edge 9 of the blank 8, comprises, as best seen in FIG. 3, a more or less trough-like body member 31, a pad 32 of resilient foam material, an elongated hollow inner member 33, and a top plate 34.

Figure 4:
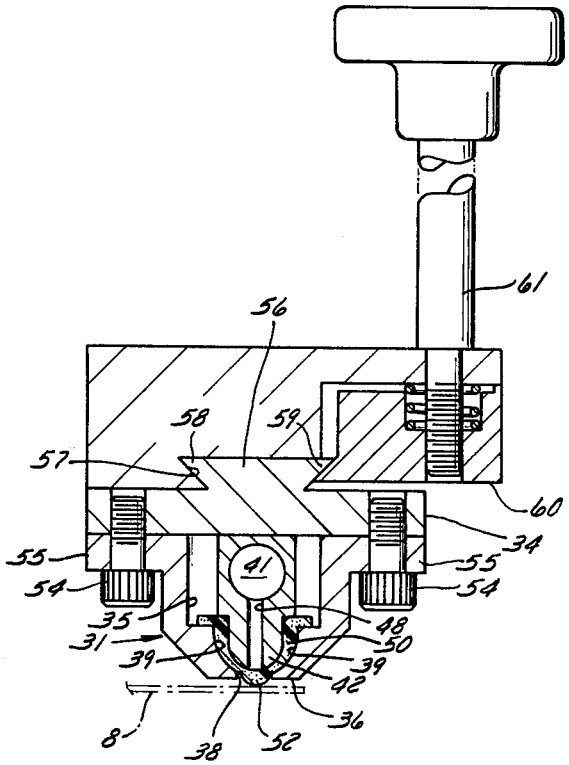
FIG. 4 is a view in cross-section of the glue applicator illustrated in FIG. 3, shown assembled and connected to its holder in a cup manufacturing machine.

The trough-like body member 31 has a cavity 35 therein that opens to its flat top surface. The top plate 34, which flatwise overlies the top surface of the body member, thus closes the mouth of the cavity 35 but need not be sealed to the body member. The body member 31 is of substantially reduced width at its bottom, where it has a flat downwardly facing surface 36. In its bottom the body member 31 has a slot 38 that corresponds in shape and size to the glue area 15 to be applied along a side edge of a blank, and the cavity 35 opens downwardly through that slot. As best seen in FIG. 4, the lower portion of the cavity 35, which is substantially narrower than its upper portion, has opposite side surfaces 39 which extend along the full length of the slot 38 and which are downwardly convergent. The respective downwardly convergent surfaces 39 intersect the flat bottom surface 36 to define the opposite longitudinal edges of the slot 38. In this case the convergent side surfaces 39 are concavely curved in transverse profile and can be formed by means of a curved-edged milling cutter (not shown) that also forms the slot 38.

The inner member 33 has an upper portion 40 that defines an elongated glue chamber 41 and has a narrower, ridge-like downwardly projecting lower portion 42 that is substantially as long as the slot 38. In this case the glue chamber 41 is defined by a bore that extends lengthwise through the wider upper portion 40 of the inner member 33 and which either stops short of one end of the inner member, as at 43, or is plugged at one end. At its open end this bore is threaded to receive a nipple 44 or similar fitting by which a hose 45 or the like can be connected with the inner member 33 for communicating its glue chamber 41 with a source of glue under pressure, which can comprise a vessel 46. The nipple 44 extends through a slot or bay 47 in one end wall of the body member 31.

Opening downwardly from the glue chamber 41 through the lower ridge portion 42 of the inner member are a plurality of outlet bores 48 that are spaced at regular intervals along the length of the ridge. The diameter of these bores is not critical because their capillary effect is not relied upon to prevent dripping, but they should be spaced at fairly close intervals along the ridge.

The pad 32 is of a resilient foam or sponge material, typically polyurethane foam. Its length is preferably somewhat greater than that of the cavity 35, and its width is such that (as best seen in FIG. 4) substantial portions 50 of it, extending along opposite sides of its longitudinally central zone 52, are clamped between the ridge portion 42 of the inner member and the convergent surfaces 36 in the lower portion of the cavity 35. The thickness of the pad 32 is such that, with the inner member 33 in place, the longitudinally extending central portion 52 of the pad bulges down through the slot 38 in the outer body member 31, to project below the flat bottom surface 36 of the body member.

Figure 5:
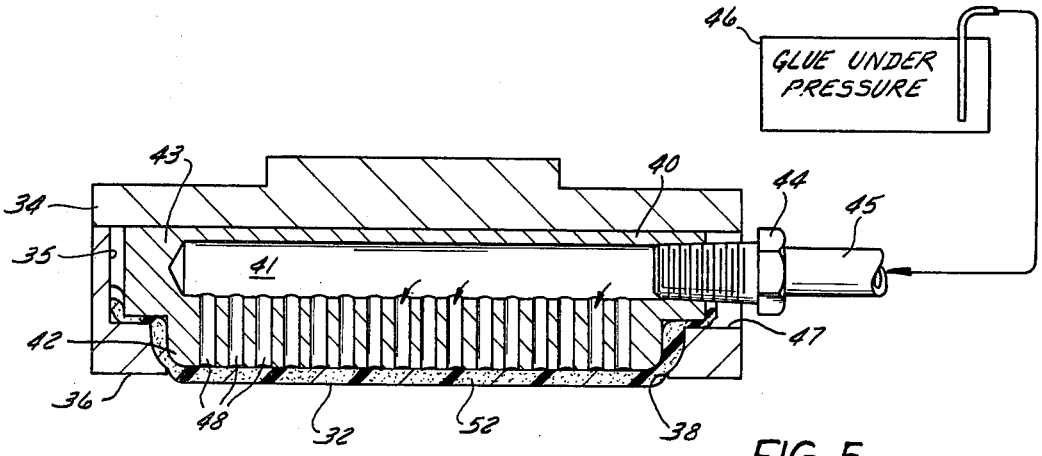
FIG. 5 is a view in longitudinal section of the glue applicator shown in FIG. 4.

The top plate 34, which has a flat bottom surface, is secured to the flat top surface of the outer body member 31, as by means of screws 54. These screws extend upward through laterally projecting, longitudinally extending flange portions 55 on the outer body member, and they are threaded into the top plate 34. As can be seen from FIGS. 4 and 5, the top plate, when in place, closely overlies the flat top surface of the inner member 33 and confines the inner member 33 in the position in which the latter makes clamping engagement with the pad 32 and forces its central portion 52 to bulge through the slot 38.

The glue applicator 27 is readily detachably securable to the underside of the mounting plate 25 that carries the glue applicators for their up and down motion. For such attachment, there is a block like dovetail connector element 56 on the top of the top plate 34. The mounting plate 25 has a laterally opening groove 57 therein in which one ridge 58 of the dovetail block 56 is received, and the opposite ridge 59 of that block is engaged by a clamping block 60 that is secured by a hand screw 61, all as shown in FIG. 4. It will be observed that this securement arrangement is substantially similar to one that has been employed with a heretofore conventional type of glue applicator, and the applicator of the present invention can thus be installed on slightly modified fittings, as a direct replacement for such a prior applicator.

In operation, glue flows from the glue vessel 46 into the glue chamber 41 of the glue applicator, and thence down through the several outlet bores 48 and into the central zone 52 of the pad 32. The bores 48 are at closely spaced intervals all along the ridge to ensure that glue will flow to all portions of the central zone 52 of the pad, and they are of large enough diameter for glue to flow freely through them. Because of the small pores in the pad 32, glue is very effectively confined in it by capillary effect, and there is no tendency towards dripping. Nevertheless, when the bulged central zone 52 of the pad is squeezed by bringing the applicator down to a position in which the flat bottom surface 36 of the body member is in contact with a blank 8, glue is extruded from the pores of the central zone of the pad and is applied to the blank in a desirably thin and even coating.

If the applicator has been inoperative for a few minutes, drying glue may form a light film on the exposed surface of the pad, but this film will be broken and removed by the next glue application, owing to the squeezing of the operative portion 52 of the pad that occurs when the applicator engages a blank 8. The applicator of this invention is thus self-cleaning to a substantial extent. When cleaning is needed, as after a relatively prolonged non-use, the applicator can often be cleaned satisfactorily by merely wiping it, because the congealed or dried glue does not have to be dug out of small apertures and glue in the pores of the pad remains liquid for a long time. If dried glue fills the pores of the pad or adheres to inner surfaces of the body member or inner member, the applicator can be completely disassembled by mere removal of the screws 54 that hold the top plate.

When the applicator of this invention replaces an applicator of the heretofore conventional type that is communicated with a pressurized glue vessel through a valve, the glue valve can remain in the installation and can be allowed to operate as before. However, because the outlets 48 are of relatively large diameter, the pressure in the glue vessel can be significantly reduced, and with this lower pressure the glue valve can be removed or kept open at all times that the machine is in operation, inasmuch as the pad 32 will prevent dripping.

Figure 6:
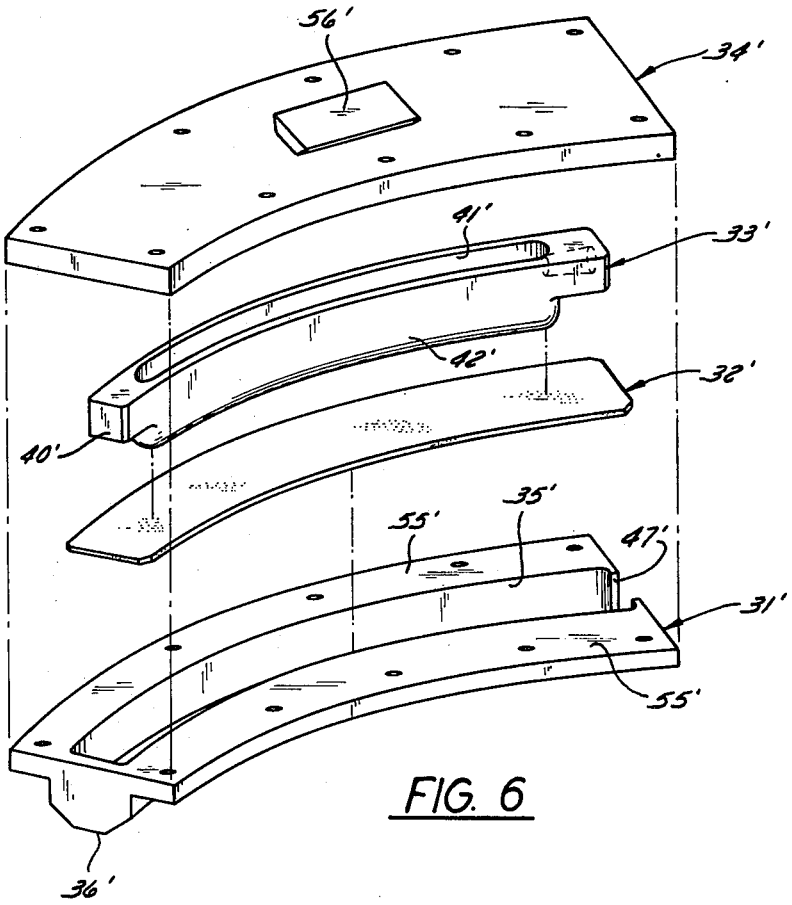
FIG. 6 is a disassembled perspective view of another embodiment of the glue applicator of this invention, particularly intended for applying glue along a bottom edge of a side wall blank.
Figure 7:
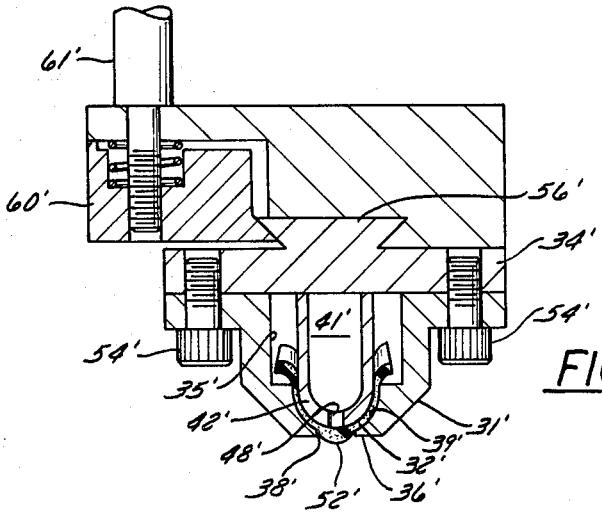
FIG. 7 is a view in cross-section of the glue applicator illustrated in FIG. 6, shown assembled and connected to its holder.

The glue applicator 28 at the second gluing station 16 can have the modified form illustrated in FIGS. 6 and 7. Since the applicator in this form is intended to apply a curved stripe-like area 17 of glue along the bottom edge 10 of the blank 8, there is a corresponding curvature along the length of each of its outer body member 31', its inner member 33', its pad 32' and its top plate 34'. Except for such curvature, the body member 31', the pad 32' and the top plate 34' are essentially identical with their respective counterparts 31, 32 and 34 in the first described embodiment. The most significant difference between the curved inner member 33' and its straight counter part 33 is in the configuration of the glue chamber 41' in its upper portion. In this case the glue chamber 41' is defined by an upwardly opening groove-like cavity in the inner member 33' that opens to its top and is closed by the top plate 34'. In reaction to the compressive force upon the clamped portions 50 of the pad 32', the inner member 33' is maintained in tight sealing engagement with the top plate 34'; hence if the mating surfaces of the inner member 33' and top plate 34' are finished to reasonable smoothness and flatness, no gasket is needed between them.

The resilient foam pads 32 and 32' must of course be replaced from time to time, but under ordinary usage replacement is necessary only after about six or eight working shifts. Because of the simple shape and low cost material of the pad, replacement pads are inexpensive; and because of the speed and ease with which an applicator can be disassembled and reassembled, pad replacement involves only negligible down time.

From the foregoing description taken with the accompanying drawings it will be apparent that this invention provides a very simple and low cost dripless glue applicator for a machine for making two-piece paper cups, which applicator can directly replace a heretofore conventional glue applicator of the type intended for connection with a pressurized glue source. It will also be apparent that the glue applicator of this invention consistently and reliably applies a thin, even film of glue in exactly a desired area, tends to be self-cleaning to a substantial extent, and can be cleaned much more quickly and easily than prior glue applicators when cleaning is needed.

I claim:

1. A machine for making paper articles such as paper cups, each formed from at least one paper blank and having a glued seam that extends along a long, narrow area of the blank, said machine being of the type comprising means providing a source of glue under pressure, a glue applicator connected with said source, and means for delivering blanks individually to said applicator for application of glue to said area of each blank, said machine being characterized by said glue applicator comprising:

A. a body member having therein a cavity that opens downwardly through an elongated slot in a flat bottom surface of said body member, which slot substantially conforms in shape and size to an area of glue to be applied, the lower portion of said cavity having oppositely downwardly convergent surfaces that extend along the full length of said slot and respectively intersect said bottom surface along opposite longitudinal edges of said slot;

B. a pad of resilient foam material received in the bottom portion of said cavity, said pad being substantially longer and wider than said slot; and C. a hollow inner member confined in said cavity in the body member, said inner member (1) having an elongated ridge-like bottom portion which is received between said convergent surfaces along substantially the full length of said slot and which forces a central portion of the pad to bulge through said slot, to below the plane of said bottom surface, while cooperating with said convergent surfaces to clampingly compress portions of the pad that are on opposite sides of said central portion and extend all along the same, (2) having an upper portion defining an elongated glue receiving chamber which is above said bottom portion, extends along substantially the full length thereof and is communicated with said source of glue under pressure, and (3) having in said bottom portion a plurality of outlets, at intervals along the length thereof, that open downwardly from said glue receiving chamber, for conducting glue from said chamber to said central portion of the pad.

2. A machine for making paper articles such as paper cups, each formed from at least one paper blank and having a glued seam the extends along a long, narrow area of the blank, said machine being of the type comprising means providing a source of glue under pressure, a glue applicator connected with said source, and means for delivering blanks individually to said applicator for application of glue to said area of each blank, said machine being characterized said glue applicator comprising:

A. a pad of resilient foam material, said pad having a length and a width which are greater than the length and the width, respectively, of the glue area to be applied;

B. an outer body member having a bottom surface and having a slot in said bottom surface that substantially conforms in shape and size to said area of glue to be applied, said outer body member having therein a cavity with opposite downwardly convergent surfaces which extend along the full length of said slot and intersect said bottom surface along the opposite longitudinal edges of the slot;

C. an inner member confined in said cavity in the outer body member and having (1) an elongated portion which is configured (a) to force a central longitudinal portion of the pad to bulge downward through said slot and (b) to clamp against said convergent surface portions of said pad that are on opposite sides of its said central longitudinal portion and extend all along the same, and (2) a hollow upper portion providing a glue chamber communicated with said source of glue under pressure and which opens downwardly through a plurality of apertures through said bottom portion, at intervals along its length, to provide for flow of glue from said glue chamber to said central longitudinal portion of the pad.

* * * * *